US010738539B1

(12) United States Patent
Olivier

(10) Patent No.: US 10,738,539 B1
(45) **Date of Patent: *Aug. 11, 2020**

(54) CONTAINMENT WORK PLATFORM

(71) Applicant: INTEGRIS RENTALS, L.L.C., Houma, LA (US)

(72) Inventor: Pierre L. Olivier, Houma, LA (US)

(73) Assignee: INTEGRIS RENTALS, L.L.C., Houma, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/038,911

(22) Filed: Jul. 18, 2018

Related U.S. Application Data

(63) Continuation of application No. 14/211,527, filed on Mar. 14, 2014, now Pat. No. 10,072,465.

(60) Provisional application No. 61/787,850, filed on Mar. 15, 2013.

(51) Int. Cl.
*E21B 15/00* (2006.01)
*E04G 3/24* (2006.01)

(52) U.S. Cl.
CPC ..... *E21B 15/00* (2013.01); *E04G 3/24* (2013.01)

(58) Field of Classification Search
CPC ..... E21B 19/155; E21B 19/20; E21B 15/02; E21B 15/00; E21B 15/04; E21B 15/045; E04G 4/00; E04G 4/24; E04G 4/20; E04G 4/305
See application file for complete search history.

(56) References Cited

U.S. PATENT DOCUMENTS 3,664,459 A * 5/1972 Stephens ..... B66F 11/042 182/141
3,896,945 A * 7/1975 Bjorklund ..... B61D 3/12 414/387
3,964,221 A * 6/1976 Berquist ..... B63B 3/48 52/177
4,372,757 A * 2/1983 Favret, Jr. ..... B01D 19/0042 210/776
4,423,527 A * 1/1984 Morris ..... E03F 5/0407 4/288
4,809,814 A * 3/1989 St-Germain ..... E04G 1/20 182/118

(Continued)

*Primary Examiner* — Katherine W Mitchell
*Assistant Examiner* — Shiref M Mekhaeil
(74) *Attorney, Agent, or Firm* — Garvey, Smith & Nehrbass, Patent Attorneys, L.L.C.; Charles C. Garvey, Jr.; Seth M. Nehrbass

(57) ABSTRACT

A support platform for enabling a worker to service an oil well next to a wellhead having a valve tree includes a platform having an upper floor, a lower floor and a cavity in between the floors. A platform provides a periphery, a central opening and radially extending beams. A plurality of walls attached to the periphery of the platform, said beams connecting to said walls below said upper floor. A drain that enables fluid to drain from the upper floor to the lower floor and into the cavity. A coupler that spans between the floors for enabling a connection to be made between the platform and valve tree. A liquid guard or other provision that disallows the escape of fluid from a floor via the central opening. One or more sleeves are provided in the cavity, each connecting to the upper floor, each sleeve having a bore that extends to and through the upper floor. Fluid that drains to the cavity is not able to escape the cavity via the sleeve or sleeve bore.

15 Claims, 15 Drawing Sheets

(56) References Cited

U.S. PATENT DOCUMENTS 4,930,598 A * 6/1990 Murrill ..... B66F 11/042 182/141
4,943,076 A * 7/1990 Tripke ..... B60R 3/00 105/449
5,069,309 A * 12/1991 Swiderski ..... E04G 1/20 16/30
5,096,171 A * 3/1992 Kendrick ..... A01D 34/001 254/88
5,170,552 A * 12/1992 Swiderski ..... E04G 1/20 29/243.5
5,203,410 A * 4/1993 Cobb ..... E21B 34/02 166/95.1
5,295,557 A * 3/1994 Taylor ..... E02D 29/12 182/113
5,467,955 A * 11/1995 Beyersmith ..... H01Q 1/1242 248/219.3
5,618,416 A * 4/1997 Haefner ..... E04D 13/0409 210/163
5,787,673 A * 8/1998 Noble ..... E04H 12/085 343/890
5,950,972 A * 9/1999 Irish ..... E06C 7/14 182/121
5,954,305 A * 9/1999 Calabro ..... H01Q 1/1242 248/219.4
6,226,955 B1 * 5/2001 Lorrigan ..... B66C 23/18 212/179
6,681,894 B1 * 1/2004 Fanguy ..... E04G 1/36 182/113
6,710,751 B2 * 3/2004 Ianello ..... E04H 12/10 248/230.1
6,779,614 B2 * 8/2004 Oser ..... E21B 19/15 166/85.1
6,793,021 B1 * 9/2004 Fanguy ..... E21B 19/163 166/380
6,830,127 B2 * 12/2004 Johnson ..... E02D 29/12 182/113
6,848,539 B2 * 2/2005 Lee ..... E04G 1/36 182/113
7,958,686 B1 * 6/2011 Majocka ..... E03F 5/0407 52/302.1
8,302,736 B1 * 11/2012 Olivier ..... E21B 15/00 182/187
D787,028 S * 5/2017 Gomo ..... D23/267
2004/0060739 A1 * 4/2004 Kadaster ..... E02B 17/00 175/57
2005/0056487 A1 * 3/2005 Concepcion ..... E06C 1/34 182/136
2005/0166315 A1 * 8/2005 Warnecke ..... E03F 5/0407 4/695
2005/0167195 A1 * 8/2005 Chipman ..... E04G 1/28 182/17
2006/0185565 A1 * 8/2006 Brochu ..... B65D 19/0059 108/57.25
2007/0033853 A1 * 2/2007 Ridge ..... A01M 31/025 43/1
2007/0087163 A1 * 4/2007 Lasly ..... B60N 3/048 428/131
2008/0028515 A1 * 2/2008 Miller ..... E03F 5/0407 4/695
2009/0236338 A1 * 9/2009 Elton ..... B65D 75/26 220/23.83
2010/0133159 A1 * 6/2010 Priester ..... E03F 5/0408 210/163
2010/0139887 A1 * 6/2010 Slessman ..... F28F 9/0265 165/67
2010/0224663 A1 * 9/2010 Butler, III ..... B60R 9/06 224/498
2010/0319281 A1 * 12/2010 Egan ..... E03F 5/0407 52/302.1
2014/0115777 A1 * 5/2014 Schulze ..... E03C 1/262 4/689
2014/0367195 A1 * 12/2014 Melton ..... E04G 1/34 182/113
2016/0265203 A1 * 9/2016 Knapp ..... E03F 5/0408
2016/0270604 A1 * 9/2016 McLeod ..... E03C 1/22
2016/0298895 A1 * 10/2016 Drach ..... F25C 5/22
2017/0107741 A1 * 4/2017 Gillespie ..... E05B 47/0047

* cited by examiner

CONTAINMENT WORK PLATFORM

CROSS-REFERENCE TO RELATED APPLICATIONS

This is a continuation of U.S. patent application Ser. No. 14/211,527, filed 14 Mar. 2014 (now U.S. Pat. No. 10,072,465, issued on 11 Sep. 2018) which claims priority of my U.S. provisional patent application No. 61/787,850, filed 15 Mar. 2013, all which are incorporated herein by reference.

My prior U.S. patent application Ser. No. 13/659,651, filed 24 Oct. 2012, (now U.S. Pat. No. 9,540,908, issued on 10 Jan. 2017), is a continuation of my prior U.S. patent application Ser. No. 12/240,136, filed 29 Sep. 2008 (now U.S. Pat. No. 8,302,736, issued on 6 Nov. 2012), which is a nonprovisional of U.S. Provisional Patent Application Ser. No. 60/976,212, filed 28 Sep. 2007 and U.S. Provisional Patent Application Ser. No. 61/022,499, filed 21 Jan. 2008, all of which are hereby incorporated herein by reference. This is not a continuation, divisional, or continuation-in-part of my prior U.S. patent application Ser. No. 13/659,651 or any patent application on which it relies for priority.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the servicing of oil and gas wells. More particularly, the present invention relates to an improved work platform that can be removably fitted to the wellhead area of an oil and gas well.

2. General Background of the Invention

The wellhead area of an oil and gas well typically provides a valve tree or "Christmas" tree. This wellhead valve tree is an assembly of pipes, valves and/or fittings. It is typically positioned at the location of the entry of the well into the earth or seabed.

Many types of remedial actions are carried out by positioning workers at or near a wellhead area or valve tree. Thus, there exists a need for a platform that can be positioned next to or upon a valve tree for supporting one or more workers that are engaged in remedial activity.

The following U.S. Patents are incorporated herein by reference:

TABLE

| PAT. NO. | TITLE | ISSUE DATE |
|---|---|---|
| 4,085,796 | Well Tubing Handling System | Apr. 25, 1978 |
| 4,085,798 | Method for Investigating the Front Profile During Flooding of Formations | Apr. 25, 1978 |
| 4,515,220 | Apparatus and Method for Rotating Coil Tubing in a Well | May 7, 1985 |
| 4,842,446 | Offshore Support Structure Methods and Apparatus | Jun. 27, 1989 |
| 5,094,568 | Offshore Support Structure Method and Apparatus | Mar. 10, 1992 |
| 5,181,799 | Offshore Support Structure Apparatus | Jan. 26, 1993 |
| 5,203,410 | Blowout Safety System for Snubbing Equipment | Apr. 20, 1993 |
| 5,295,557 | Utility Construction Safety and Work Platform | Mar. 22, 1994 |
| 5,498,107 | Apparatus and Method for Installing Cabled Guyed Caissons | Mar. 12, 1996 |
| 5,954,305 | Adaptable Antenna Mounting Platform for Fixed Securement to an Elongated Mast Pole | Sep. 21, 1999 |
| 6,226,955 | Method and Apparatus for Handling Building Materials and Implements | May 8, 2001 |
| 6,681,894 | Portable Well Head Work Platform | Jan. 27, 2004 |
| 6,779,614 | System and Method for Transferring Pipe | Aug. 24, 2004 |
| 6,830,127 | Pipeline Construction Safety Platform | Dec. 14, 2004 |
| 6,848,539 | Work Platform for Blowout Preventer Stacks | Feb. 1, 2005 |
| 2005/0129464 | Motion Compensation System and Method | Jun. 16, 2005 |

BRIEF SUMMARY OF THE INVENTION

The present invention provides a support platform for enabling a worker to service an oil well next to the wellhead area of the oil and gas well, the wellhead area typically providing a valve tree.

The apparatus includes a platform having an upper floor, a lower floor and a cellar in between the floors.

The platform provides a periphery, a central opening and radially extending beams that are attached to the floors for reinforcing same. A plurality of walls are attached to the periphery of the platform, the beams connecting to the walls below the upper floor.

A drain enables fluid to drain from the upper floor to the lower floor and into the cellar or reservoir. A coupler spans between the floors and enables a connection to be made between the platform and the valve tree.

The connector can include a liquid guard that disallows escape of fluid from the floor via the central opening.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
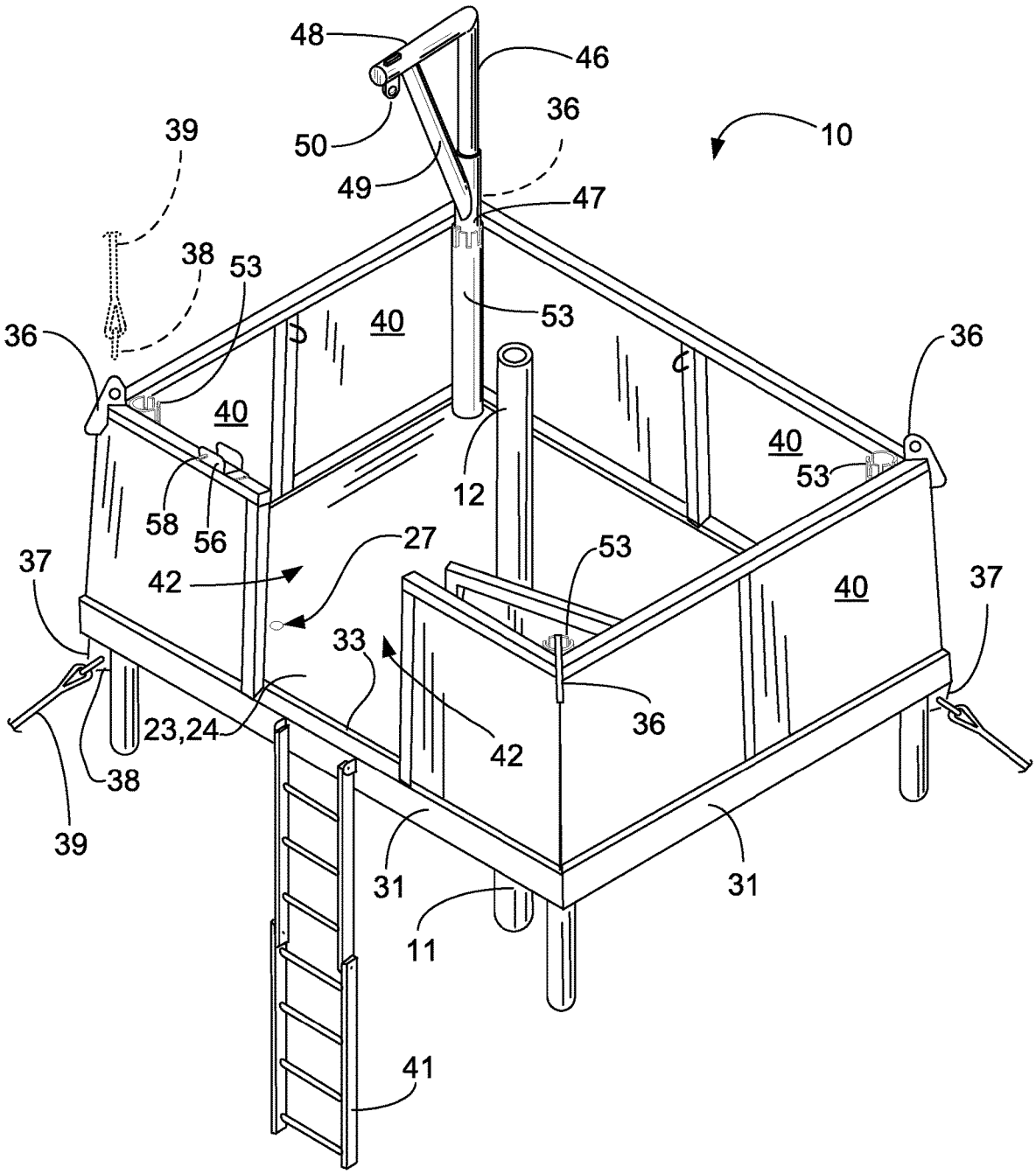
FIG. 1 is a perspective view of a first embodiment of the apparatus of the present invention showing the access door in an open position.
Figure 2:
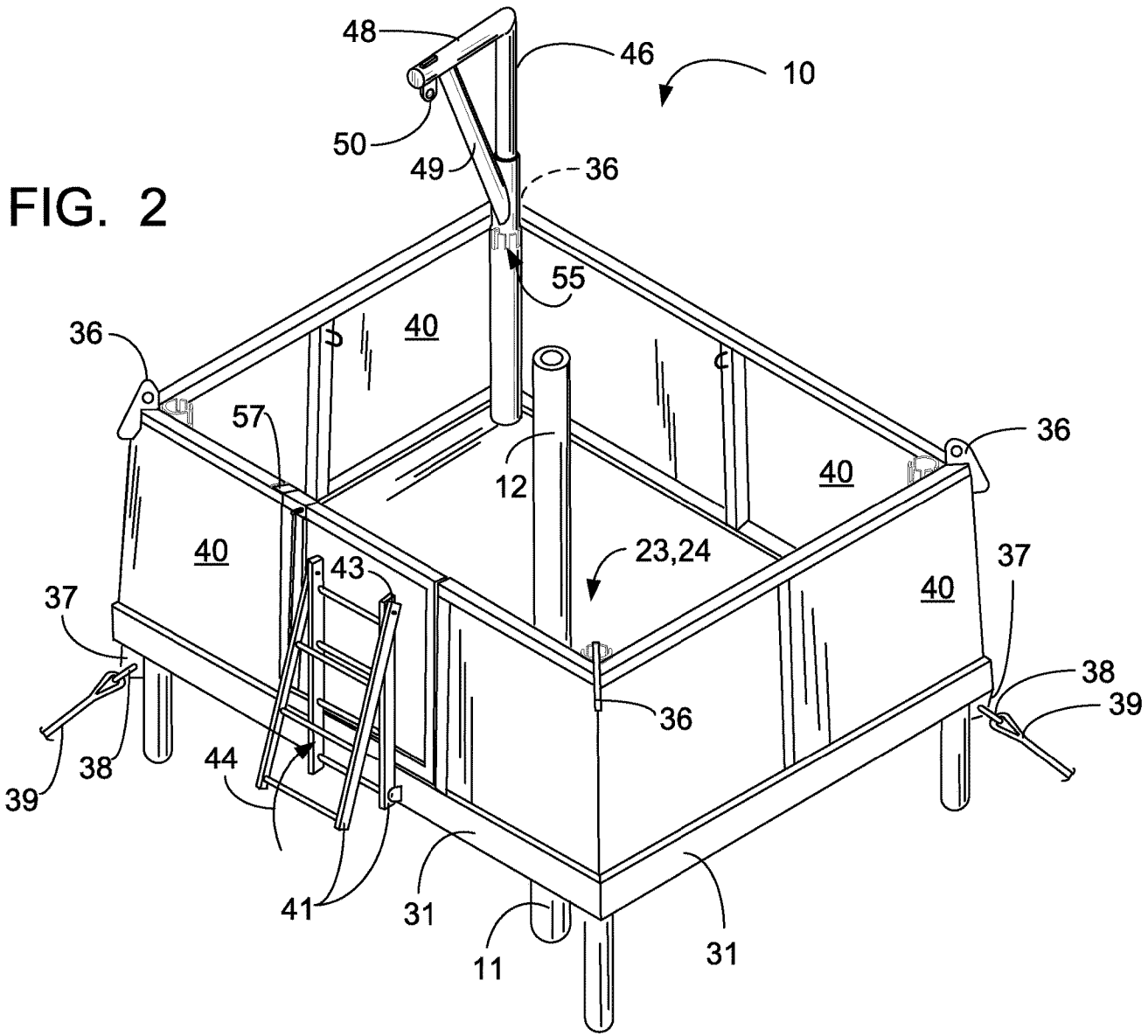
FIG. 2 is a perspective view of the first embodiment of the apparatus of the present invention showing the access door in a closed position.
Figure 3:
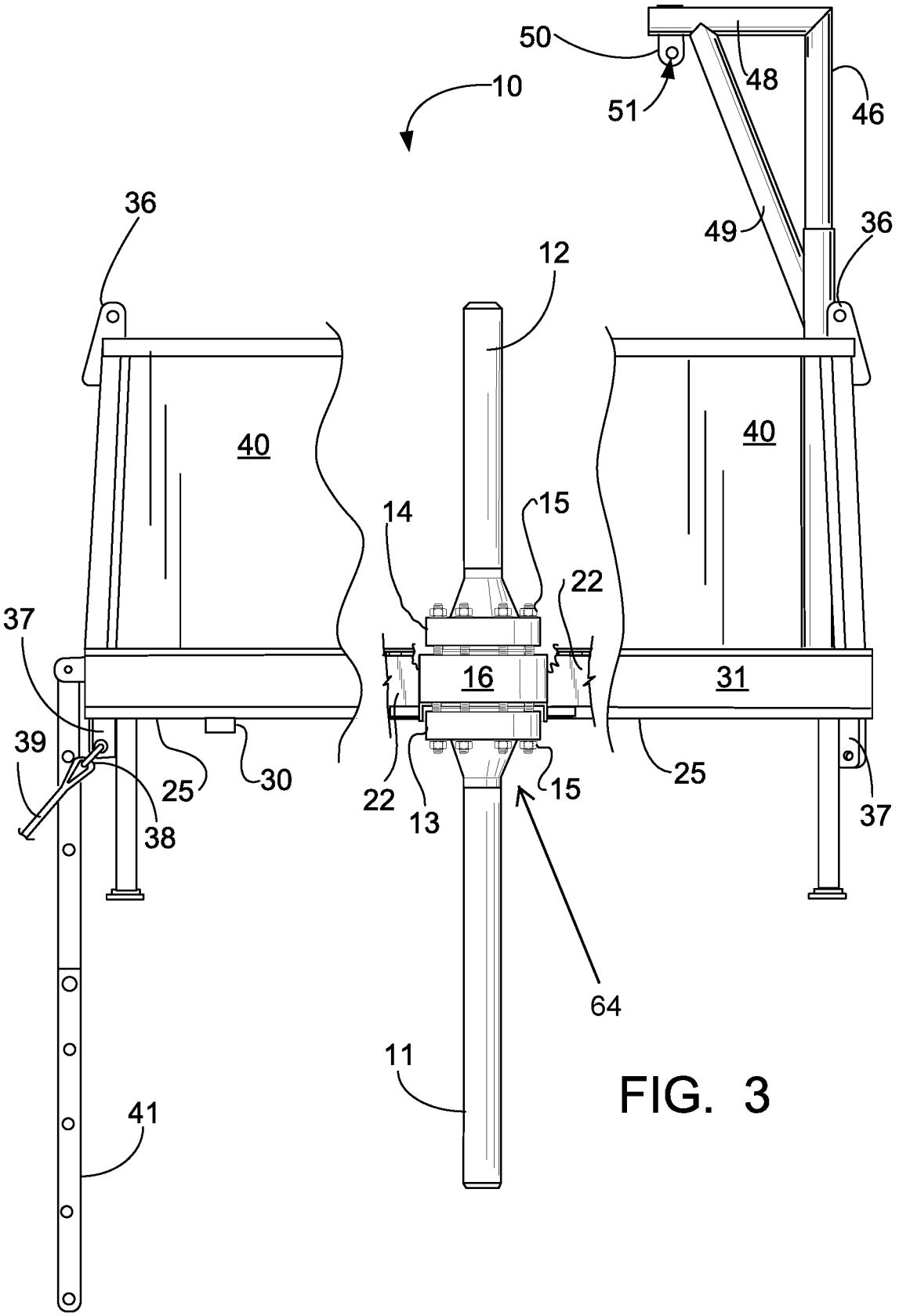
FIG. 3 is a sectional, partially cut-away view of the first embodiment of the apparatus of the present invention.

FIGS. 1-11 show a first embodiment of the apparatus of the present invention, designated generally by the numeral 10 in FIGS. 1-3. Wellhead servicing platform 10 provides a structure that can be attached to a wellhead area such as an existing, known valve tree or the riser section of the valve tree. In FIGS. 1-3, the riser section of a valve tree 64 can include riser sections 11, 12. Each riser section can be fitted with an annular pipe flange. The riser section 11 has annular pipe flange 13. The riser section 12 has annular pipe flange 14.

Each annular pipe flange 13, 14 can be connected to annular flange 16 using one or more bolted connections 15. The annular flange 16 provides a flange central opening 17 that enables communication to flow from one riser section 11 to the other riser section 12 via central opening 17.

Figure 4:
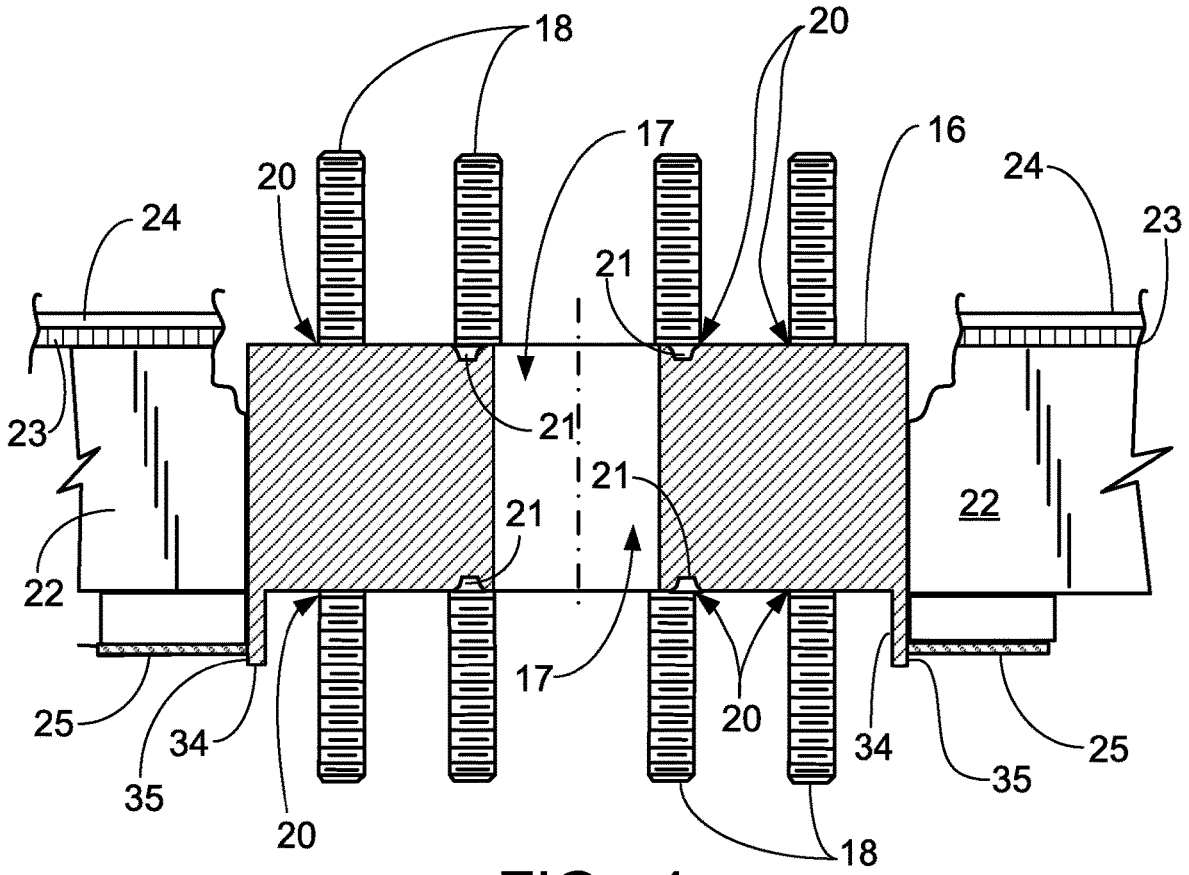
FIG. 4 is a detailed fragmentary view of the first embodiment of the apparatus of the present invention.
Figure 5:
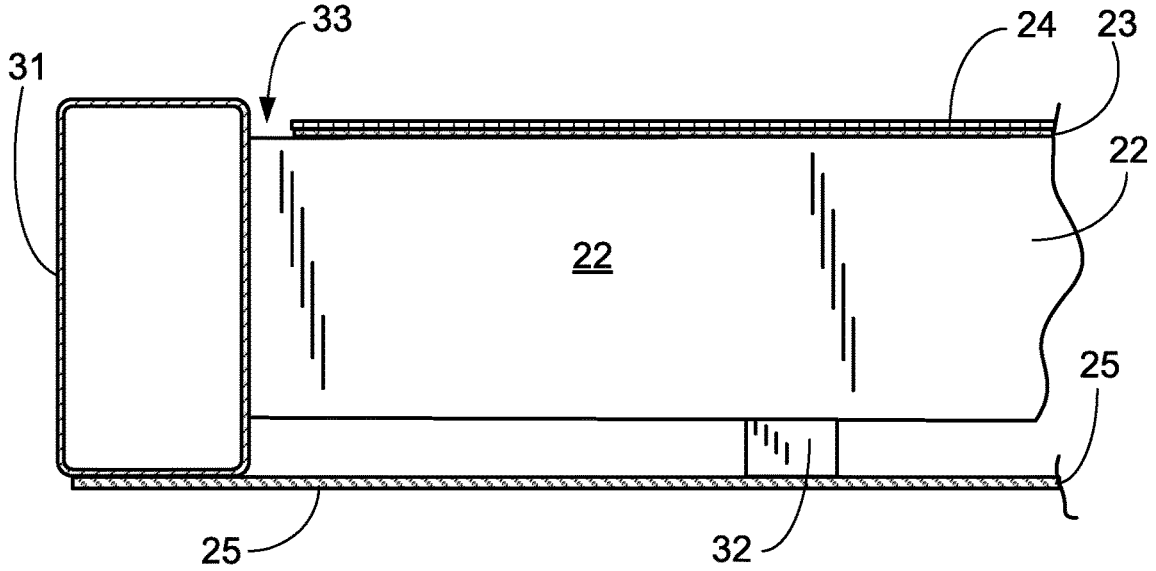
FIG. 5 is a fragmentary sectional view of the first embodiment of the apparatus of the present invention.
Figure 7:
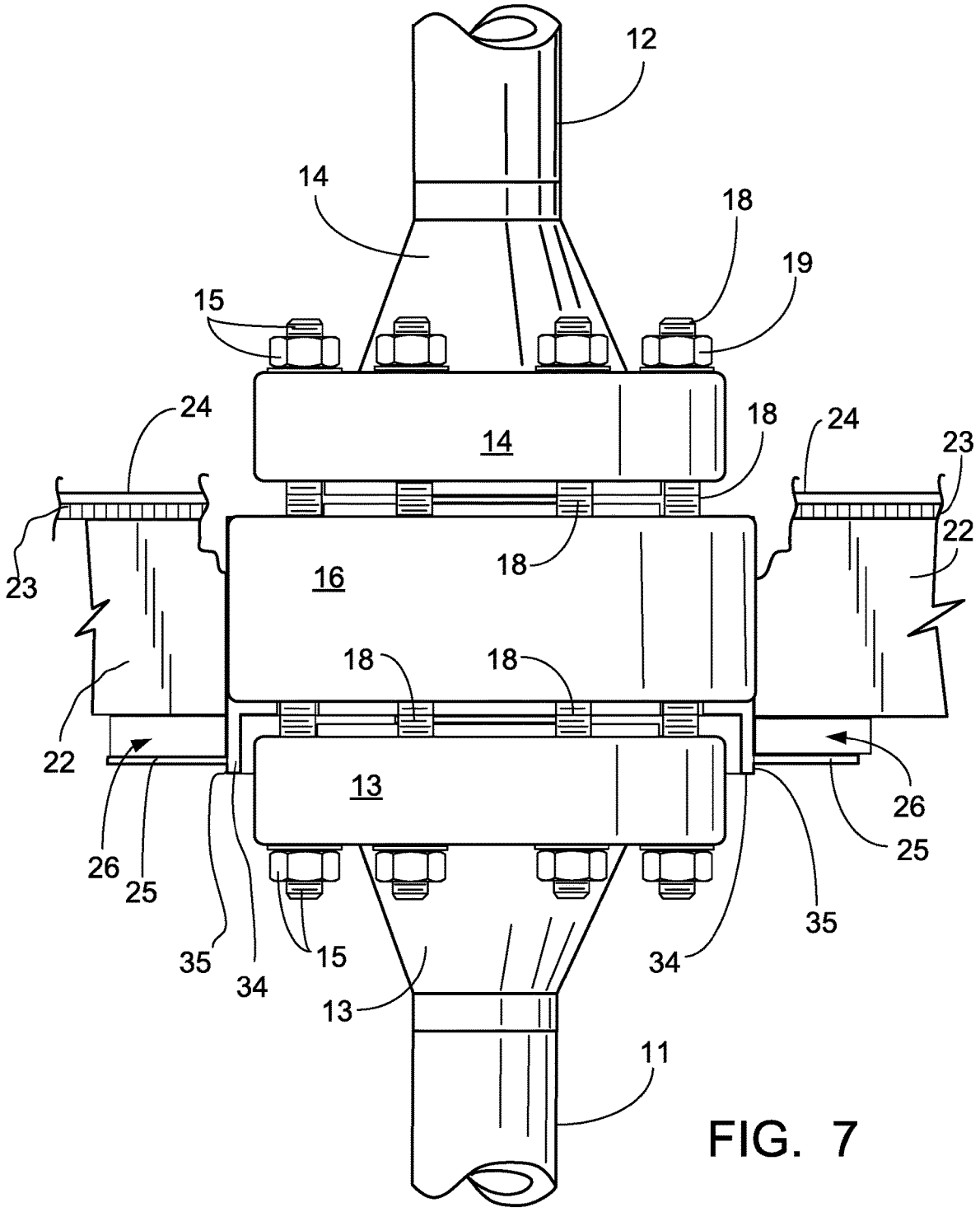
FIG. 7 is a sectional view taken along lines 7-7 of FIG. 6.

Bolted connection 15 can employ a plurality of threaded studs 18, each fitted with a plurality of nuts 19 as shown in FIGS. 3, 4 and 7. Flange 16 provides a plurality of openings 20, each opening 20 being receptive of a threaded stud 18. The openings 20 align with correspondingly sized and shaped openings of the flanges 13, 14. The flange 16 can be provided with annular grooves 21 that can be fitted with sealing members such as sealing rings or gaskets.

A plurality of radially extending beams 22 are fastened at one end portion to flange 16 and at their opposing end portions to the periphery 29 of platform 10. Circumferentially extending stiffener plates 52 can be placed in between and connected to each pair of beams 22 (see FIG. 6). At the platform periphery 29 there are provided peripheral beams 31 as shown in FIGS. 1-3 and 5. Upper floor 23 can be connected to the upper surface of beams 22. Lower floor 25 can be connected to peripheral beams 31 and to radially extending beams 22 using stiffener plates 32. The construction of beams 22, 31 and floors 23, 25 can be welded aluminum or like construction. Upper floor 23 can be provided with a perforated plate layer 24 for traction purposes (see FIGS. 4-7). Perforated plate layer 24 can be tack welded to floor 23.

A reservoir or cellar 26 is a void space provided in between upper floor 23 and lower floor 25. The reservoir/cellar 26 receives any fluid flow that spills upon upper floor 23 and flows via drains 27 or drainage slot 33 (FIG. 5) during work over or other repair or maintenance operations. A drain/valve 30 can be used for removing fluid that is collected in reservoir/cellar 26.

Figure 6:
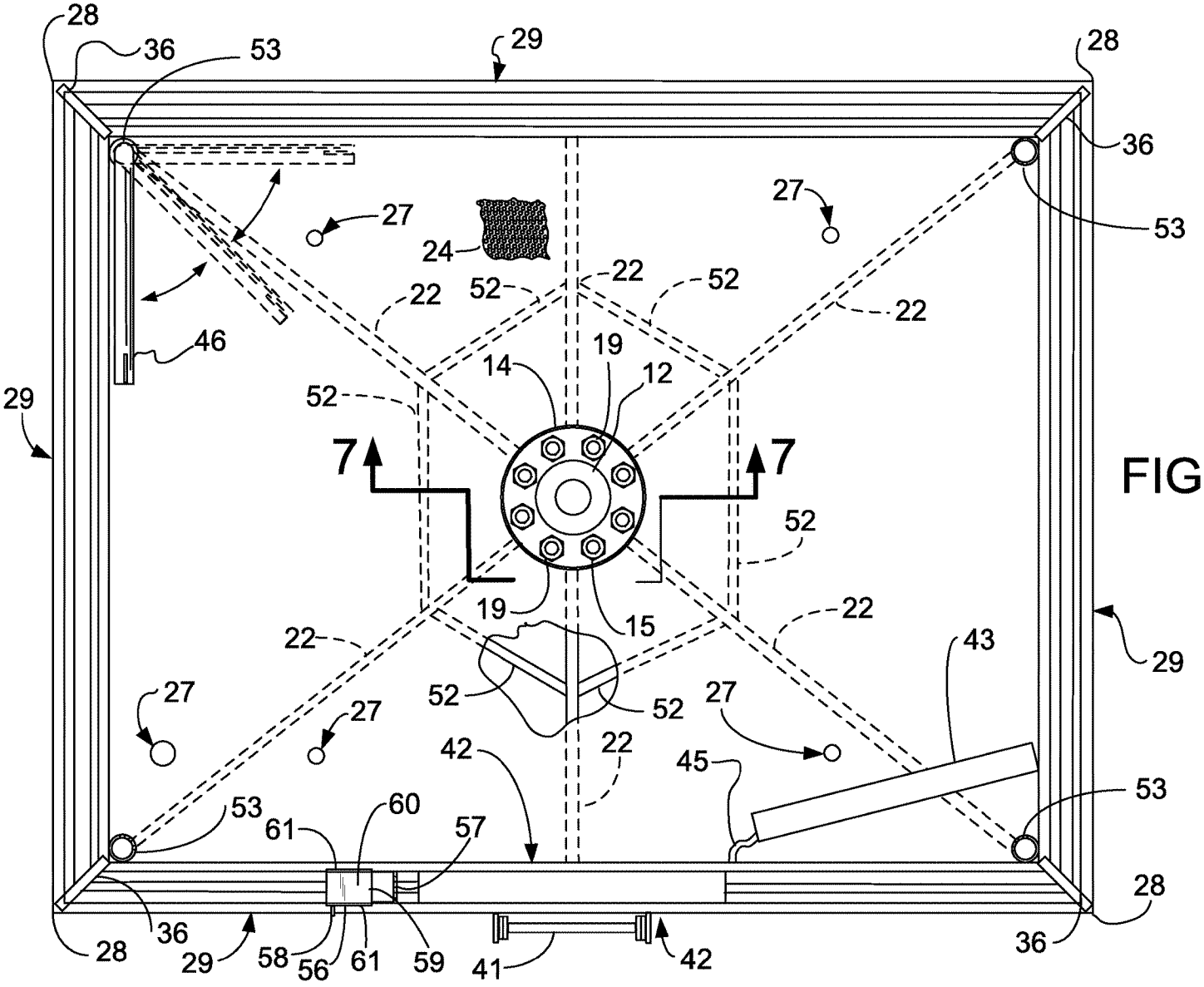
FIG. 6 is a plan view of the first embodiment of the apparatus of the present invention.

Platform 10 provides platform corners 28 (FIG. 6). At least some of the radially extending beams 22 connect to a platform corner 28 as shown in FIG. 6. Annular skirt 34 extends downwardly from annular flange 16 as shown in FIG. 4. Lower floor 25 can be attached to annular skirt 34 at its lower end portion 35.

Platform 10 can be provided with a plurality of lifting lugs 36 and a plurality of tie back lugs 37. For lifting the platform 10 such as during placement, the lifting lugs 36 can be fitted with shackles 38 and slings 39 or other suitable rigging for enabling a crane or other lifting device to lift and place platform 10. Such shackles 38 and slings 39 can also be attached to lugs 37.

Figure 12:
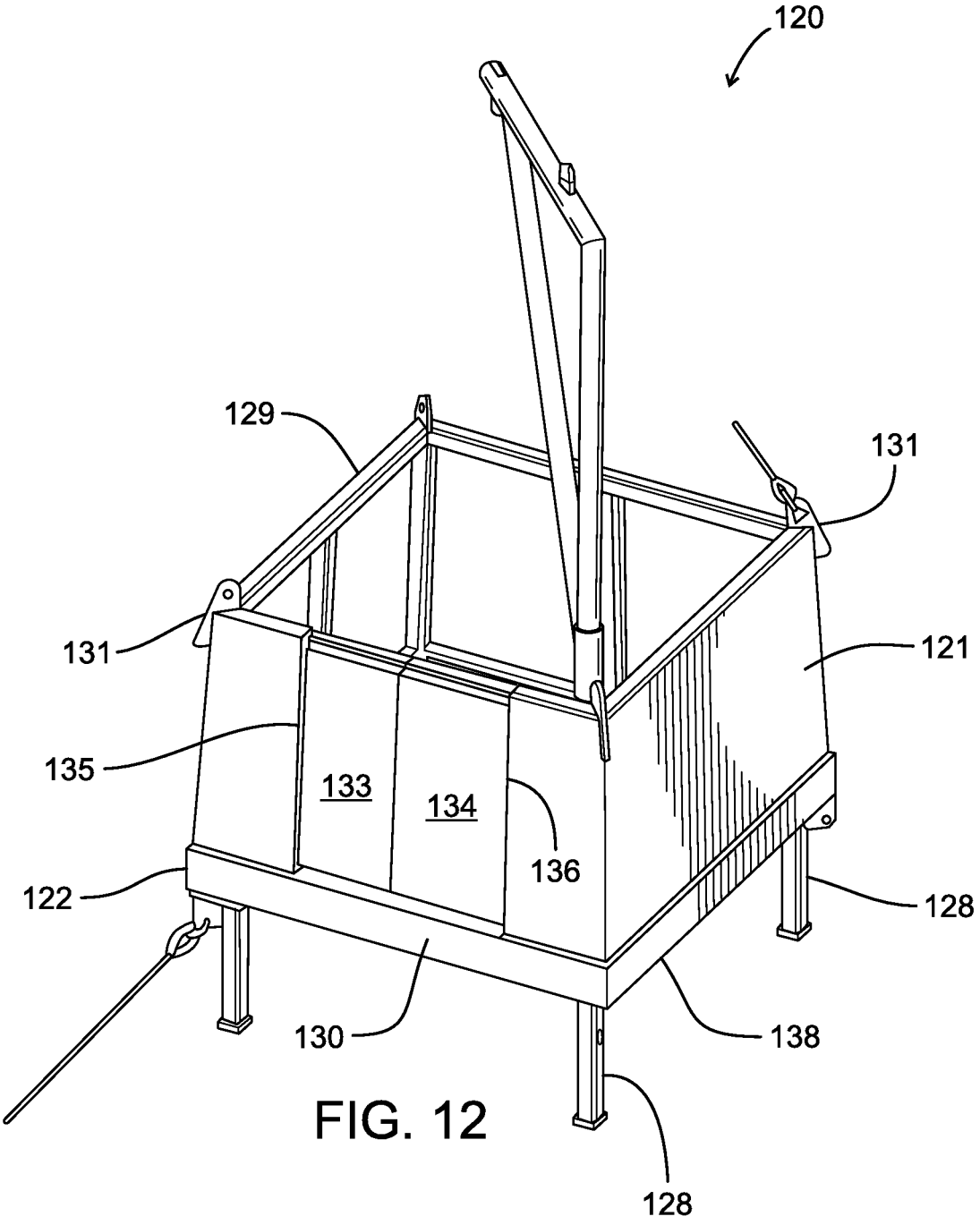
FIGS. 12 and 13 are perspective views of an alternative embodiment of the apparatus of the present invention.
Figure 13:
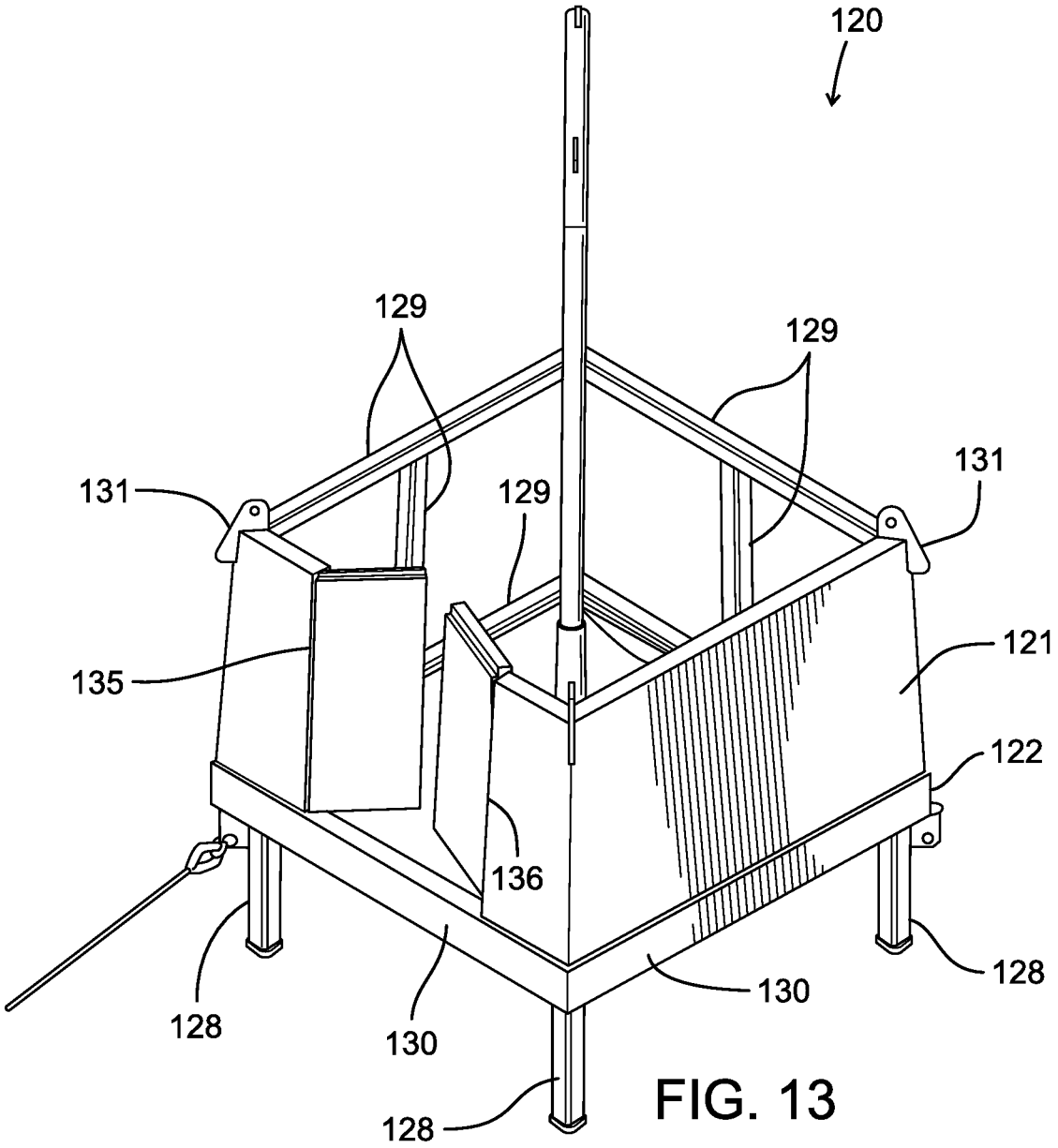
Figure 14:
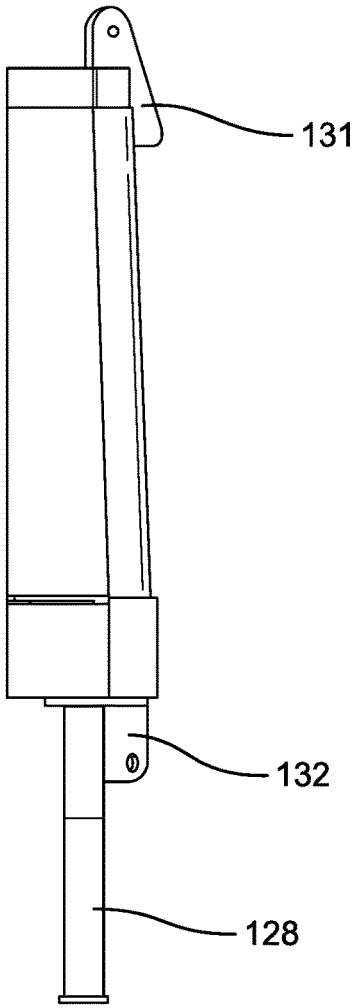
FIGS. 14-18 are fragmentary views of an alternative embodiment of the apparatus of the present invention.
Figure 15:
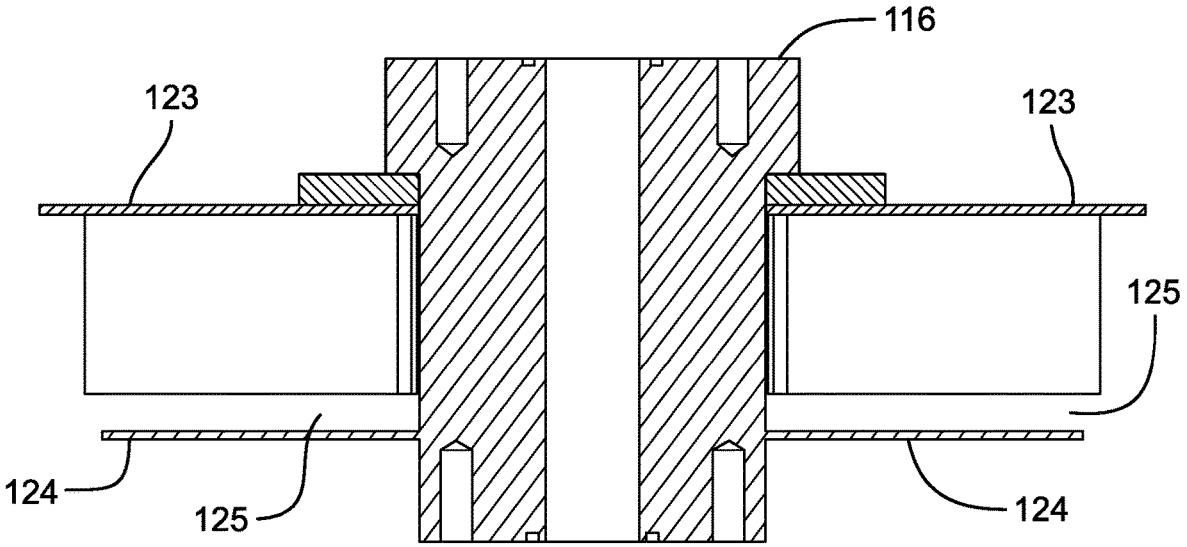
Figure 16:
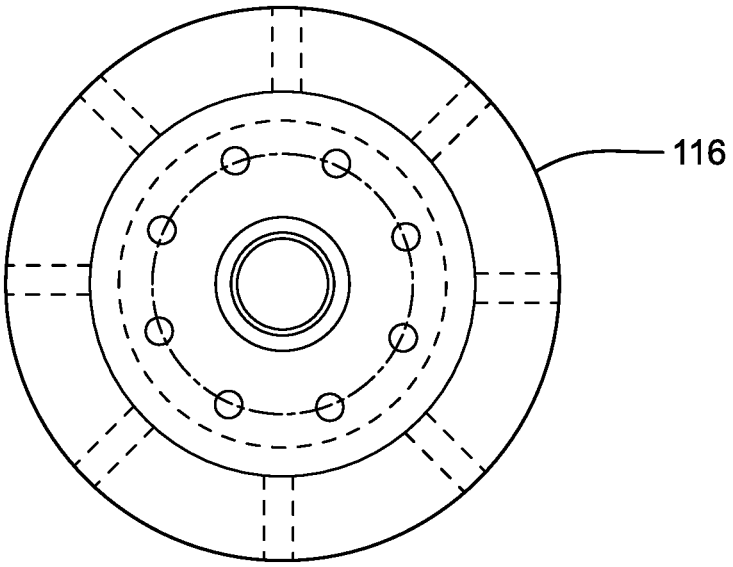

Platform 10 is provided with a plurality of sidewalls 40. A folding ladder 41 can be provided below entry 42 which is fitted with a door 43 or a pair of doors (e.g., see FIGS. 12-13). Ladder 41 can be opened and closed as indicated by arrow 44. Ladder 41 shown in FIG. 2, for example, is a two-section folding ladder. Ladder 41 could be replaced with another ladder with more sections, such as five sections, for example. Door 43 can be attached to one of the sidewalls 40 using a hinge 45. Sidewalls 40 form a dam around upper floor 23.

Platform 10 can be made of, for example, aluminum, carbon steel or stainless steel. It can be, for example, around 6' wide by 6' long to 12' wide by 12' long. It could be, for example, around 8' by 8', around 8' by 10', or around 12' by 12'. The sidewall 40 can be for example around 3'-6' high, preferably around 3'-5' high, and even more preferably around 3'-4' high.

There is a gooseneck or lifting device 46 which can be received in any of a plurality of provided receivers 53. There is preferably a receiver 53 positioned next to each corner 28 (sec FIGS. 1 and 6). Each receiver 53 can be provided with an upper end portion having circumferentially spaced apart vertical slots 55 or notches. A correspondingly sized and shaped lug 62 or projection on column 47 of lifting device 46 would be interlocked with a selected vertical slot of receiver 53 to affix lifting device 46 boom 48 in a selected angular orientation (see arrows 63, FIG. 8). For example, slots 55 or notches could be provided about 30-45 degrees apart. Lifting device 46 includes a column 47 and a boom 48 attached to the top of column 47 as shown. Diagonal brace 49 can be provided, spanning between column 47 and boom 48 as shown. Padeye 50 is attached (e.g. welded) to the boom 48 free end as shown. Preferably suspended from boom 48 padeye 50 at opening 51 is a safety lanyard point. The point could be a padeye 50 as shown to which to connect an antifall device, such as Galvanized Aircraft Cable Retractable Lanyard Item No. 21402 (commercially available from TASCO).

Figure 8:
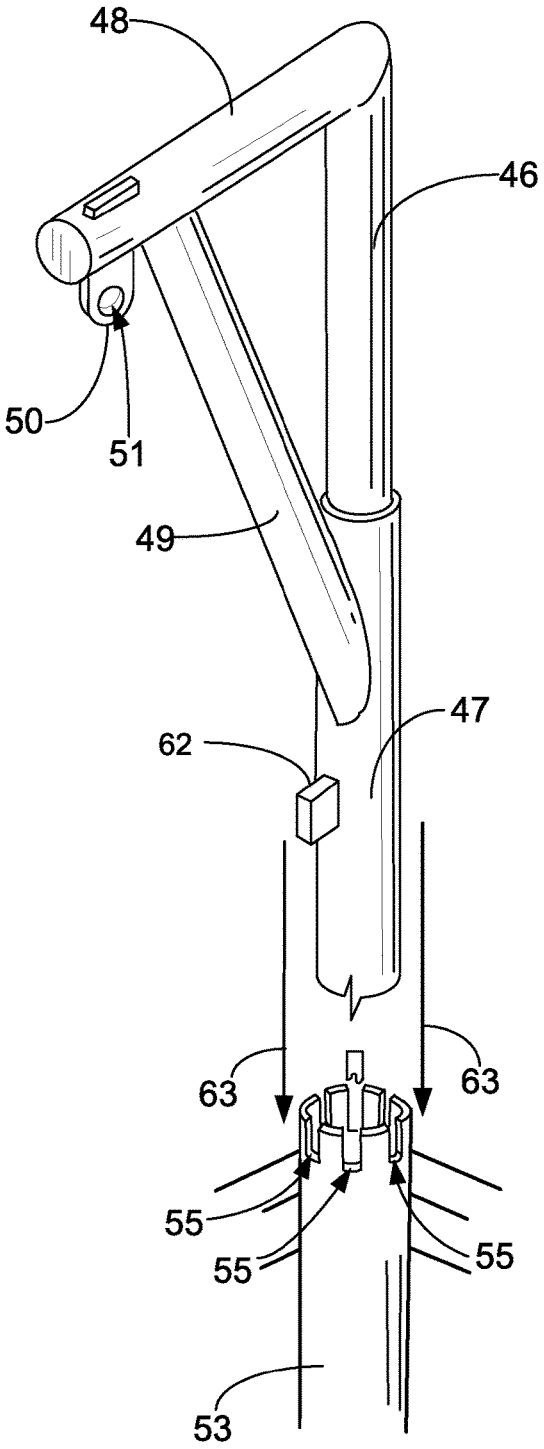
FIG. 8 is a partial perspective view of a first embodiment of the apparatus of the present invention.
Figure 9:
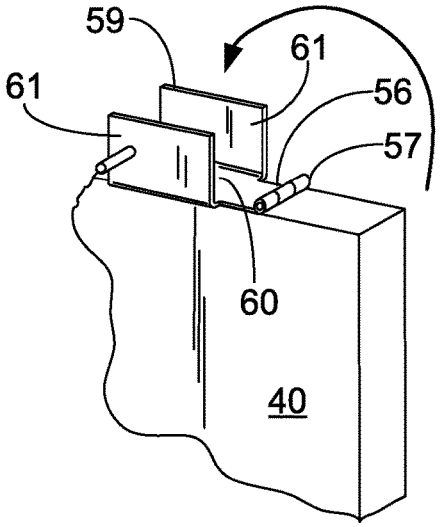
FIG. 9 is a fragmentary view of the first embodiment of the apparatus of the present invention showing the door latch in an open position.
Figure 10:
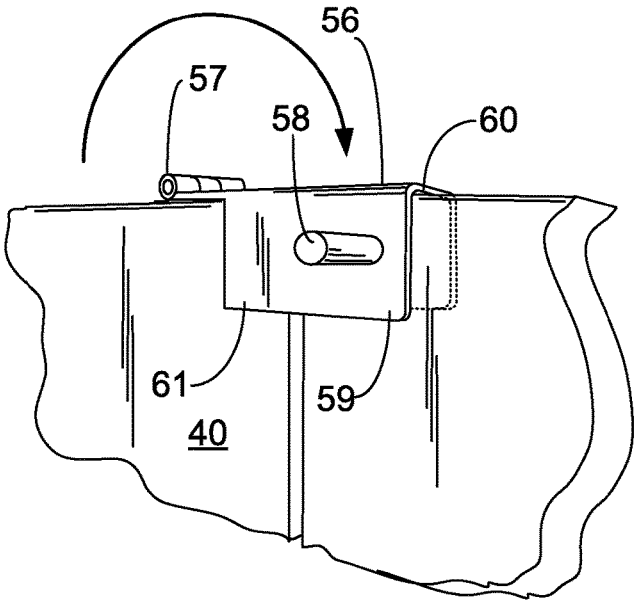
FIG. 10 is a fragmentary view of the first embodiment of the apparatus of the present invention showing the door latch in a closed position.

Receiver 53 can have three notches 55 as shown in FIG. 1 or six notches 55 as shown in FIG. 8. In the latter case, the top of receiver 53 preferably extends above the sidewall 40 as shown in FIG. 8 so the lug/projection 62 can be received in the outer notches 55 without contacting sidewall 40. Preferably, the top of receiver 53 is not higher than the center of the shackle eye in lifting lug 36; otherwise, it might interfere with lifting lines connected to lifting lugs 36.

Eyelets or lanyard loops 54 can be positioned at intervals around the periphery of platform 10, such as on each sidewall 40 (see FIG. 1). The eyelets are life line attachment points for enabling a worker to attach his or her harness or safety line thereto to prevent an inadvertent fall.

Latch 56 holds door 43 in a closed position. Latch 56 is pivotally attached using hinge 57 to a sidewall 40 that is next to door 43 as shown in FIGS. 1-2, 6, and 9-10. Latch 56 has a handle 58 for enabling a user to grip and pivot it. Latch 56 employs u-shaped member 59 having web 60 and flanges 61.

Figure 11:
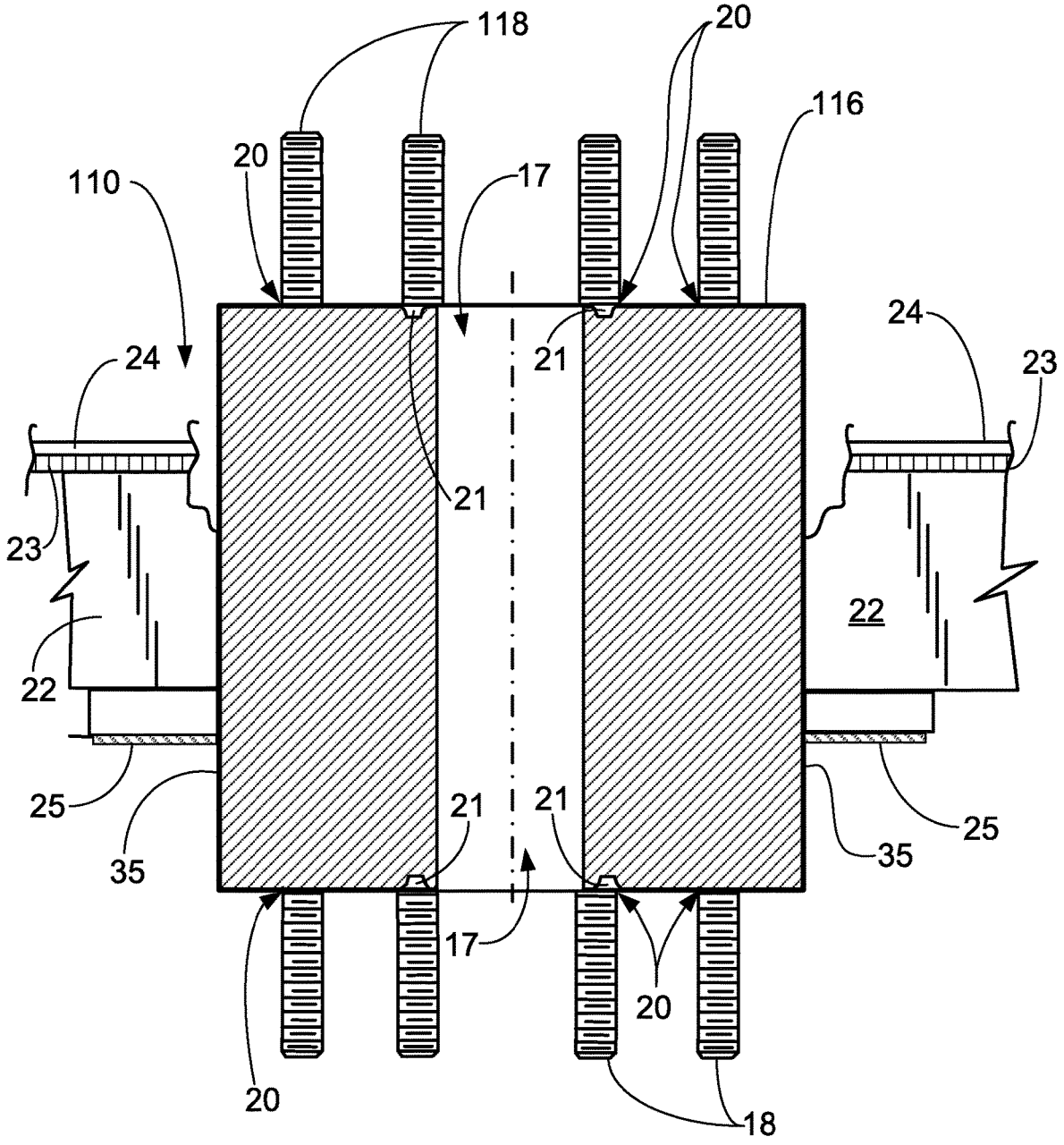
FIG. 11 is a detailed fragmentary view of a second embodiment of the apparatus of the present invention, similar to FIG. 4, but showing a preferred coupler member (central annular flange).

FIG. 11 shows a preferred flange 116. Flange 116 preferably extends upwardly from floor 23 preferably about 0.5-24 inches, more preferably about 1-12 inches, even more preferably about 2-10 inches, even more preferably about 2-6 inches, and most preferably about 3 inches. Flange 116 preferably extends downwardly from floor 25 preferably about 0.5-24 inches, more preferably about 1-12 inches, even more preferably about 2-10 inches, even more preferably about 2-6 inches, and most preferably about 3 inches. Flange 116 makes it easier to connect annular pipe flanges 13 and 14 to platform 110 by providing a protruding connection, as bolts 118 extend further from the floors and thus are easier to see and to line up with pipe flanges 13 and 14. Preferably, flange 116 acts not only as a coupler but also as a liquid guard that disallows the escape of fluid from a floor 23, 25 via the central opening.

FIGS. 12-25 show an alternative embodiment of the apparatus of the present invention, designated generally by the numeral 120. As best seen in FIGS. 12-25, wellhead servicing platform 120 has sidewalls 121 that slant inward toward the center of platform 120. This is advantageous in that it provides toe space to workers when they approach sidewalls 121 and it also keeps the workers' centers of gravity back from the edge of the platform, making it less likely that a worker will fall over a sidewall 121.

Platform 120 provides a structural frame 122 (e.g., welded steel) that can be structural tubing such as square tubing 129 or rectangular tubing 130. These sections of tubing 129, 130 can be welded together to form a structural frame 122 that supports the plurality of sidewalls 121 (e.g., four) as well as a pair of vertically spaced apart floor panels 123, 124 (see FIGS. 12-13, 15). These floor panels 123, 124 include an upper floor panel 123 and a lower floor panel 124. Slots, openings or the like can be provided in upper panel floor section 123 for enabling a drainage of fluids into a space or cellar or cavity 125 that is in between panels 123, 124 (see FIG. 15). The cellar or space or cavity 125 thus contains any fluid that might spill on upper floor 123 and flow to cellar 125 via floor drains, thus preventing a pollution of the surrounding environment which can in many cases be a marine environment.

Figure 17:
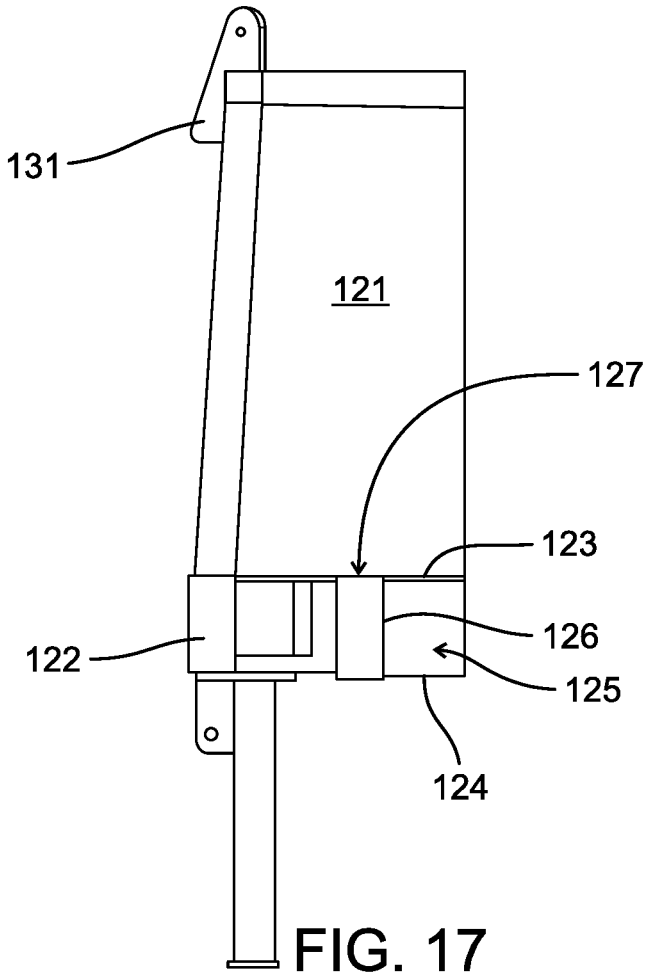
Figure 18:
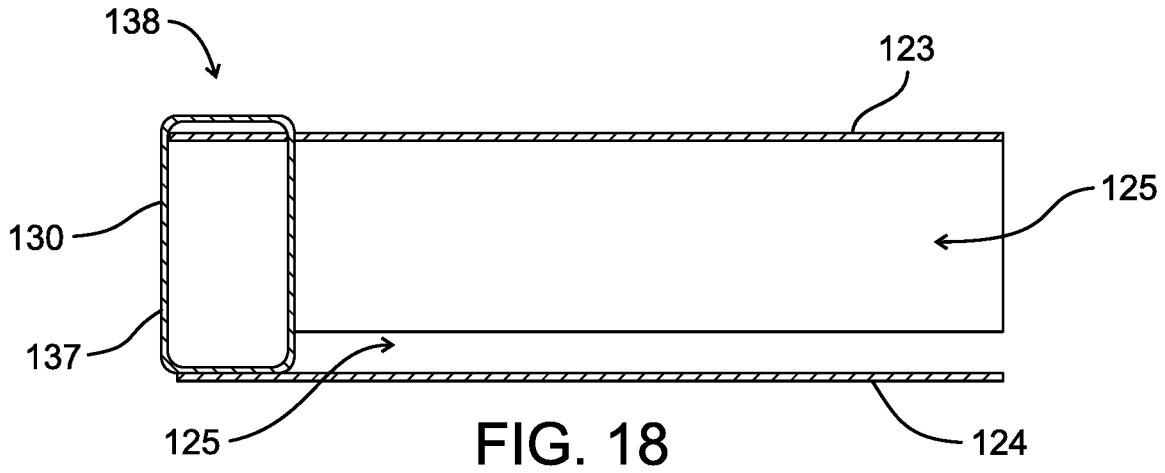
Figure 19:
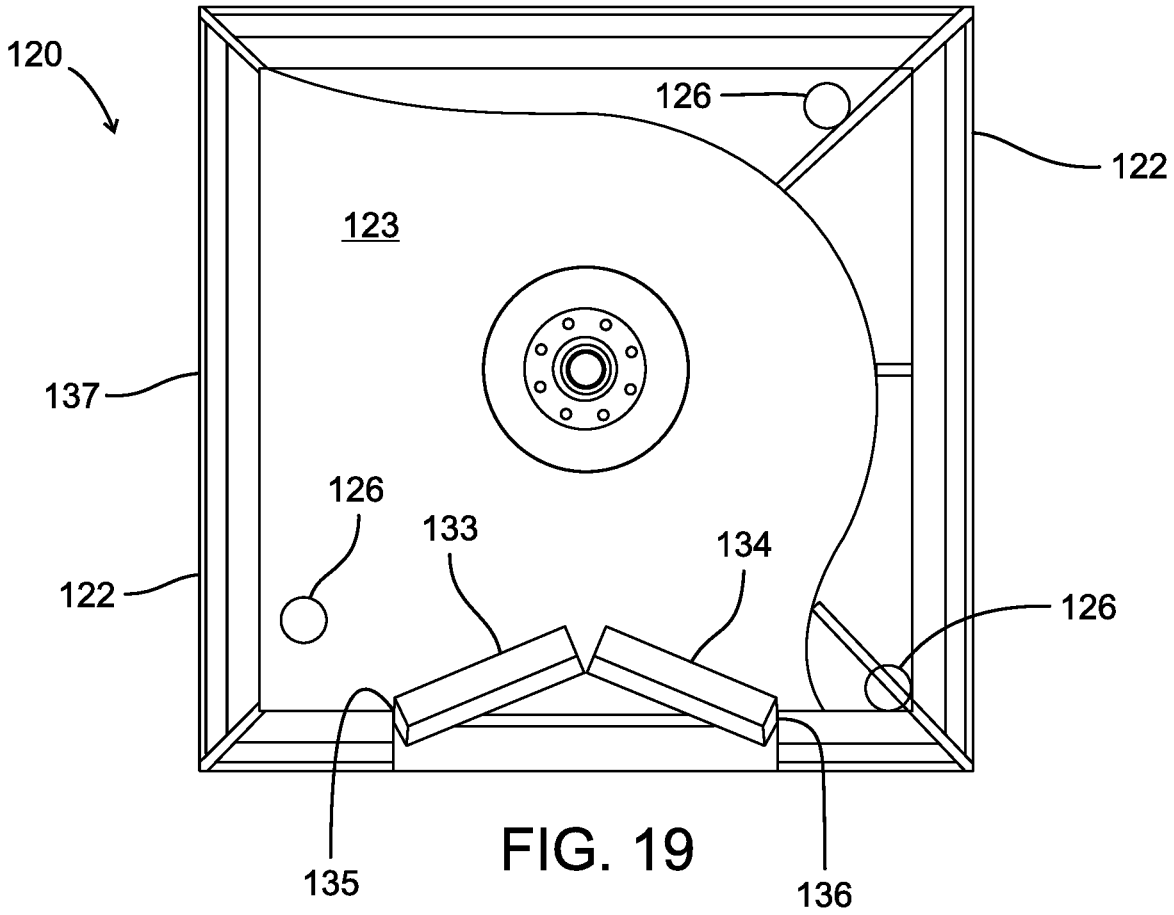
FIG. 19 is a top view of an alternative embodiment.
Figure 20:
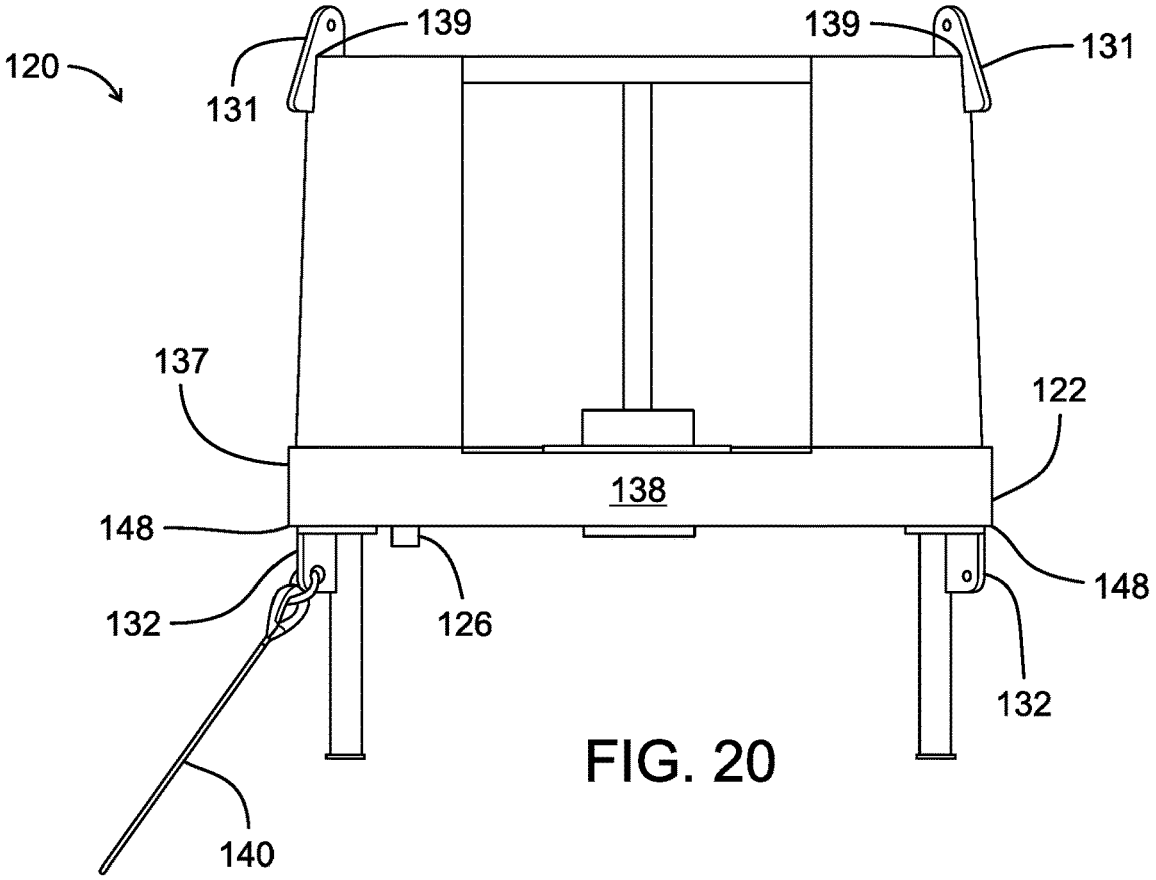
FIGS. 20-21 are elevation views of an alternative embodiment.
Figure 21:
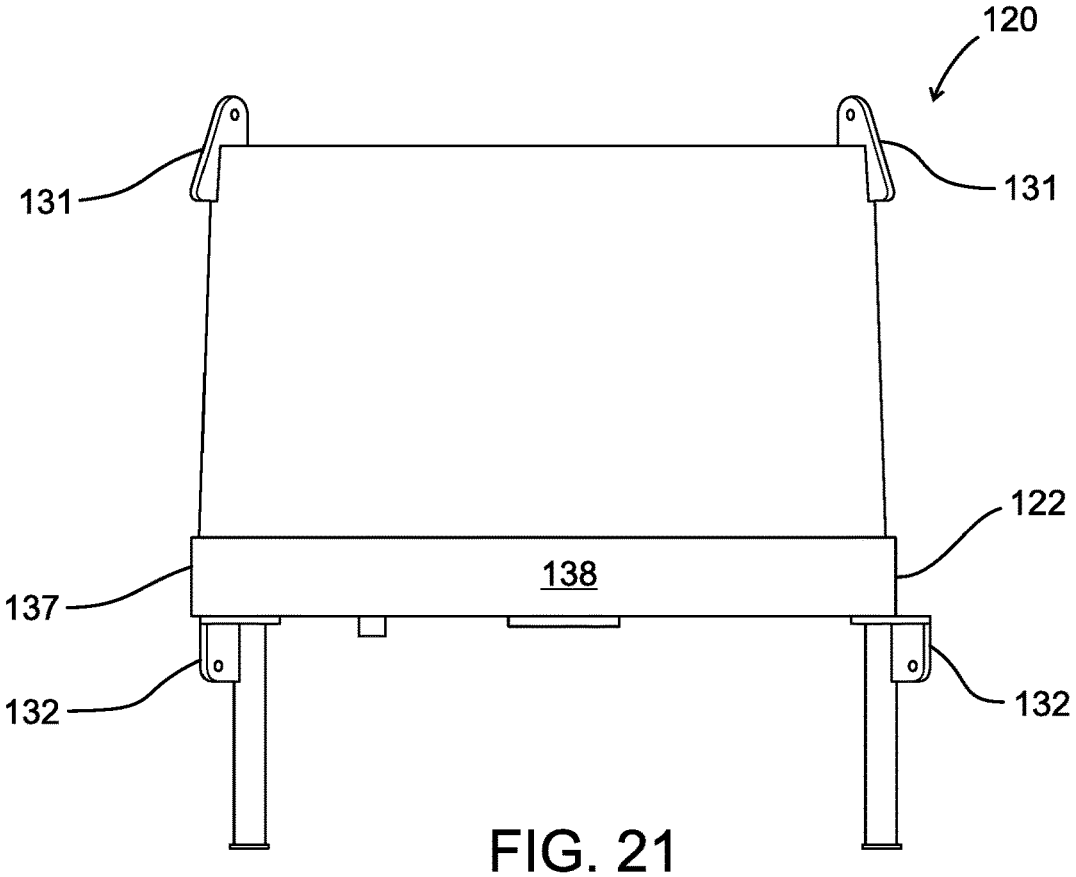
Figure 22:
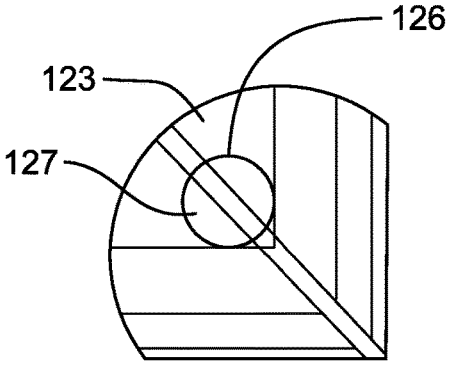
FIGS. 22-25 are fragmentary views of an alternative embodiment.

A plurality of tool receptive, floor reinforcing sleeves 126 are provided, each sleeve extending between the upper floor or panel 123 and the lower floor or panel 124 (see FIG. 17). Each sleeve has an open ended bore 127. In this fashion, a worker can place a tool (e.g., various downhole tools, such as wireline tools, electric line tools, or coil tubing tools) in sleeve 126 for holding that tool in a convenient position when the worker is not using the tool. Each sleeve 126 is sealably affixed at its upper end portion to the upper floor panel 123 and at its lower end portion to a lower floor panel 124. Thus, any fluid contained in the cavity or cellar 125 cannot escape via sleeve 126 or bore 127 to the surrounding environment. Each sleeve 126 is spaced in between flange 116 and periphery 137 (see FIGS. 15-16, 19). The sleeves 126 thus maintain spacing between floor panels 123, 124 to provide reinforcing against deflection of one panel 123 relative to the other panel 124.

Figure 23:
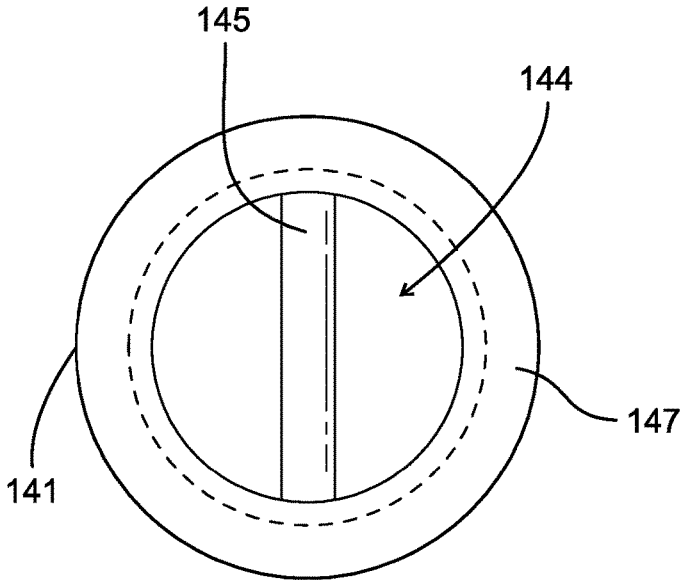
Figure 24:
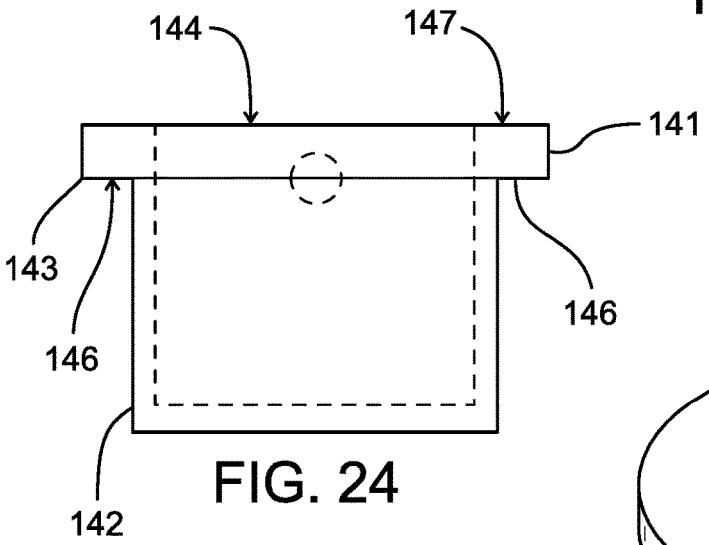
Figure 25:
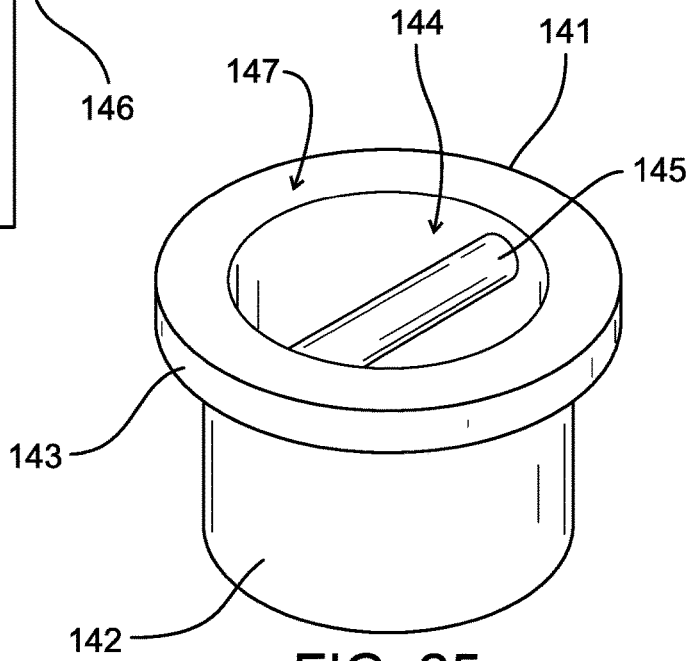

FIGS. 23-25 show a plug or closure member 141 that would be placed in the bore 127 of sleeve 126. Bore 127 would be sized and shaped to correspond to the outer surface of plug or closure member 141. The closure member 141 has a lower cylindrical section 142 and an upper larger diameter annular flange 143. An opening or socket 144 carries a handle 145 that is below upper surface 147. An annular shoulder 146 of plug 141 would abut and correspond in size and shape to a similar annular shoulder of sleeve 126 and bore 127. In this fashion, the upper surface 147 of plug 141 would be at the same elevation and thus flush with upper floor panel 123. If a worker is standing on upper floor panel 123, the plug 141 would prevent the worker from tripping on or catching his or her foot on sleeve 126 when sleeve 126 was not being used to carry a tool (see FIGS. 17, 22-25). Platform 120 can be provided with a plurality of legs 128. Tubing 129, 130 preferably includes larger rectangular tubing 130 at the periphery 137 of platform 120 (see FIGS. 12, 18). Thus, four sections of rectangular tubing 130, each about six feet long are connected end to end to form a rectangular base 138 which also includes the upper and lower floor panels 123, 124.

The upper floor panel 123 can be attached (for example, welded) to the top of the connected plurality of rectangular tubing sections 130. Similarly, the lower floor panel 124 can be welded to the bottom of the rectangular tubing sections 130. This detail can be seen for example in FIGS. 14 and 18.

A plurality of lifting eyes 131 are provided, one lifting eye at each upper corner 139. A plurality of tie down eyes or lugs 132 are provided, one at each lower corner 148. Wire cables 140 can be provided for attachment to eyes 132 (see FIGS. 20-21). The apparatus 120 includes doors 133, 134, each attached to a sidewall 121 at a hinge 135 or 136 (see FIG. 12). Doors 133, 134 are preferably self-closing with exterior counter weights. Preferably there is a squirrel cage ladder system (not shown) positioned in front of doors 133, 134. Also, preferably there is a removable plate (for example a square 6" by 6" or rectangular 4" by 6"—screwed in place or preferably flush-mounted with a hinge and/or a recessed handle (held in place with gravity)) on the surface floor above the drain area portion to allow inspection of the drain and to allow removal of debris which might prevent the outward or downward flow of fluids from the cellar through the drain.

The apparatus 120 can be equipped with be a squirrel cage ladder system connected with hammer unions instead of pins. One can offset the connector approximately one inch, which helps balance the ladder and provides more entry door clearance. Connectors can be sizes, for example, DSA 3 1/16"-15M (KPSI) 5 1/8"-15M (KPSI).

Class 1 Division 1 lights preferably have a 100-foot, explosion-proof cord. They are slung with tested and inspected pad eye, and have four adjustable height positions. A 65-foot extension cord with a dual plug is available. Lights are 400-watt metal halide. Ground wire is 10 feet. Alternatively, a Class 1 Division 1 150-watt LED explosion-proof floodlight provides a brighter white light with less amp draw. They are 70 pounds, with the LED light on a quadpod stand or ladder bracket. The ladder bracket can also be used on handrails or scaffolding, with mount adjustable claims from 28 inches to 41 inches. Explosion-proof straight blade plug is adjustable from 7 feet to 13 feet high, with 100-foot 16/3 SOOW yellow cord. Removable plexiglass and aluminum guards are available.

The platform can be for example 6 feet wide by 6 feet long with a 3 1/16"-15M PSI, 2 9/16"-5M PSI, 2 9/16"-10M PSI, or 2 9/16-15M PSI DSA for use in wireline operations. This platform can also be used for coil tubing. It is smaller and lighter than the larger platforms and preferably has a double door entry so that the doors will clear the center flange. The safety davit will be shorter than the safety davit of the larger platforms.

The following is a list of parts and materials suitable for use in the present invention.

PARTS LIST

| Part Number | Description |
|---|---|
| 10 | wellhead servicing platform |
| 11 | riser section |
| 12 | riser section |
| 13 | annular pipe flange |
| 14 | annular pipe flange |
| 15 | bolted connection |
| 16 | annular flange |
| 17 | flange central opening |
| 18 | threaded stud |
| 19 | nut |
| 20 | opening |
| 21 | annular groove |
| 22 | radially extending beam |
| 23 | upper floor |
| 24 | perforated plate layer |
| 25 | lower floor |
| 26 | reservoir/cellar |
| 27 | drain |
| 28 | platform corner |
| 29 | platform periphery |
| 30 | drain/valve |
| 31 | peripheral beam |
| 32 | stiffener plate |
| 33 | drainage slot |
| 34 | annular skirt (liquid guard) |
| 35 | lower end portion |
| 36 | lifting lug |
| 37 | tie back lug |
| 38 | shackle |
| 39 | sling |
| 40 | sidewall |
| 41 | folding ladder |
| 42 | entry |
| 43 | door |
| 44 | arrow |
| 45 | hinge |
| 46 | lifting device |
| 47 | column |
| 48 | boom |
| 49 | diagonal brace |
| 50 | padeye |
| 51 | opening |
| 52 | stiffener plate |
| 53 | receiver |
| 54 | eyelet/lanyard loop |
| 55 | vertical slot |
| 56 | door latch |
| 57 | hinge |
| 58 | handle |
| 59 | u-shaped member |
| 60 | web |
| 61 | flange |
| 62 | lug/projection |
| 63 | arrow |
| 110 | platform |
| 116 | flange |
| 118 | bolts |
| 120 | wellhead servicing platform |
| 121 | side wall |
| 122 | structural frame |
| 123 | upper floor panel |
| 124 | lower floor panel |
| 125 | cellar/cavity |
| 126 | sleeve |
| 127 | open ended bore |
| 128 | leg |
| 129 | square tubing section |
| 130 | rectangular tubing section |
| 131 | lifting eye |
| 132 | tie down eye/lug |

-continued

PARTS LIST

| Part Number | Description |
|---|---|
| 133 | door |
| 134 | door |
| 135 | hinge |
| 136 | hinge |
| 137 | periphery |
| 138 | rectangular base |
| 139 | upper corner |
| 140 | wire cable |
| 141 | plug/closure member |
| 142 | lower cylindrical section |
| 143 | annular flange |
| 144 | opening/socket |
| 145 | handle |
| 146 | annular shoulder |
| 147 | upper surface |
| 148 | lower corner |

All measurements disclosed herein are at standard temperature and pressure, at sea level on Earth, unless indicated otherwise.

Hereby incorporated herein by reference is information at http://www.integris-rentals.com/containment.php, about a commercial embodiment of the present invention.

The foregoing embodiments are presented by way of example only; the scope of the present invention is to be limited only by the following claims.

The invention claimed is:

1. A worker support apparatus that enables a worker to service an oil well next to a wellhead having a valve tree, comprising:

a) a platform having an upper floor, a lower floor, multiple corners and a cellar cavity in between the floors;

b) the platform having a periphery, a central opening, a plurality of peripheral beams and a plurality of radially extending beams, said plurality of radially extending beams extending in said cellar cavity; wherein one or more of said radially extending beams extends from said central opening to one of said peripheral beams;

c) a plurality of walls attached to the periphery of the platform, said peripheral beams connecting to said walls above said upper floor, wherein one or more of said radially extending beams extends to one of said peripheral beams at a position in between two of said corners;

d) an opening that enables fluid to drain from the upper floor to the cavity;

e) a coupler that spans between the floors for enabling a connection to be made between the platform and valve tree;

f) a liquid guard that disallows the escape of fluid from the upper and lower floors via the central opening;

g) one or more sleeves in the cellar cavity, each sleeve affixed to said upper floor and said lower floor, each said sleeve having a bore that extends through the upper floor and the lower floor; and h) wherein fluid contained in the cavity is not able to exit the cavity via the sleeve.

2. The support apparatus of claim 1 wherein the platform is generally rectangular, having said corners and wherein one of said radially extending beams extends to one of said corners.

3. The support apparatus of claim 2 wherein multiple of said radially extending beams extend to said corners.

4. The support apparatus of claim 2 wherein one or more of the radially extending beams connects at beam end portions to one or more of said corners and to the coupler.

5. The support apparatus of claim 1 wherein each of said radially extending beams has a height that is equal to a majority of a distance between the upper floor and the lower floor.

6. A worker support apparatus that enables a worker to service an oil well next to a wellhead having a valve tree, comprising:

a) a platform having an upper floor, a lower floor, multiple corners, and a cellar cavity in between the floors;

b) the platform having a periphery, a central opening, a plurality of peripheral beams and a plurality of radially extending beams, said plurality of radially extending beams extending in said cellar cavity; wherein one or more of said radially extending beams extends from said central opening to one of said peripheral beams; wherein one or more of said radially extending beams extends to one of said peripheral beams at a position in between two of said corners; each of said radially extending beams has a height that is equal to a majority of a distance between the upper floor and the lower floor;

c) a plurality of walls having a height of around 3°-6' attached to the periphery of the platform, said plurality of peripheral beams connecting to said walls above said upper floor, the walls forming a dam around the upper floor and sealing the cellar at the platform periphery;

d) a drain that enables fluid to drain from the upper floor to the lower floor;

e) a coupler that occupies the central opening and that spans between the floors, the coupler enabling a connection to be made between the platform and the valve tree, the coupler extending above the upper floor and below the lower floor;

f) at least two doors in the walls.

7. The support apparatus of claim 6 wherein the platform is generally rectangular, having said corners and wherein one of said radially extending beams extends to one of said corners.

8. The support apparatus of claim 7 wherein multiple of said radially extending beams extend to said corners.

9. The support apparatus of claim 2 wherein one or more of the radially extending beams connects at beam end portions to one or more of said corners and to the coupler.

10. The support apparatus of claim 6 wherein the walls extend above the upper floor.

11. The support apparatus of claim 10 wherein the platform is generally rectangular, having said corners and wherein one of said radially extending beams extends to one of said corners.

12. The support apparatus of claim 11 wherein multiple of said radially extending beams extend to said corners.

13. A containment work platform, comprising:

a) an upper floor, a lower floor, multiple corners and a cellar cavity in between the floors;

b) a periphery, a central opening, a plurality of peripheral beams and a plurality of radially extending beams, said plurality of radially extending beams extending in said cellar cavity; wherein one or more of said radially extending beams extends from said central opening to one of said peripheral beams; wherein one or more of said radially extending beams extends to one of said peripheral beams at a position in between two of said corners; each of said radially extending beams has a height that is equal to a majority of a distance between the upper floor and the lower floor;

c) a plurality of walls attached to the periphery of the platform, said peripheral beams connecting to said walls above said upper floor, the walls forming a dam around the upper floor, sealing the cellar cavity at said periphery, and having a height of around 3'-6';

d) a drain that enables fluid to drain from the upper floor to the lower floor;

e) a coupler that spans between the floors for enabling a connection to be made between the platform and a valve tree;

f) a liquid guard that disallows the escape of fluid from the upper and lower floors via the central opening;

g) at least two doors attached to the walls; and h) wherein one of said radially extending beams extends to one of said plurality of peripheral beams at a position below said doors.

14. The platform of claim 13 further comprising a valved drain for draining fluids from the cellar cavity.

15. The platform of claim 13 wherein the walls extend above the upper floor.

* * * * *